US005675353A

United States Patent [19]

Tanaka et al.

[11] Patent Number: 5,675,353

[45] Date of Patent: Oct. 7, 1997

[54] METHOD AND APPARATUS FOR DRIVING A LIQUID CRYSTAL PANEL

[75] Inventors: Shinichi Tanaka, Niihari-mura; Takeshi Nosaka, Tsuchiura, both of Japan

[73] Assignee: Texas Instruments Incorporated, Dallas, Tex.

[21] Appl. No.: 524,317

[22] Filed: Sep. 6, 1995

[51] Int. Cl.[6] ..... G09G 3/36

[52] U.S. Cl. ..... 345/96; 345/94; 345/209

[58] Field of Search ..... 345/94, 96, 100, 345/209

[56] References Cited

U.S. PATENT DOCUMENTS 4,926,168 5/1990 Yamamoto et al. ..... 345/96

*Primary Examiner*—Mark R. Powell

*Assistant Examiner*—Matthew Luu

*Attorney, Agent, or Firm*—Richard L. Donaldson; William B. Kempler

[57] ABSTRACT

An LCD driving circuit which reduces the effective voltage difference of the applied voltage waveform between different pixels and suppresses crosstalk. The LCD panel has a single matrix LCD panel 10; scan electrode drive circuit 12, and signal electrode drive circuit 14 for driving scan electrodes X and signal electrodes Y, respectively, of the LCD panel 10; controller 16 for controlling the two drive circuits 12 and 14; level shifter 17 for shifting the level of the signal from controller 16 with respect to scan electrode drive circuit 12; and host computer 18 for feeding image data VD and timing signal TS to controller 16. Controller 16 is made of scan selection control unit 20 and display control unit 22. Selection order decision circuit 26 of scan selection control unit 20 determines the order of scan electrodes X on which the selection scan voltage is to be applied in an interval shorter or longer than an alternation period by means of line alternation operation.

2 Claims, 11 Drawing Sheets

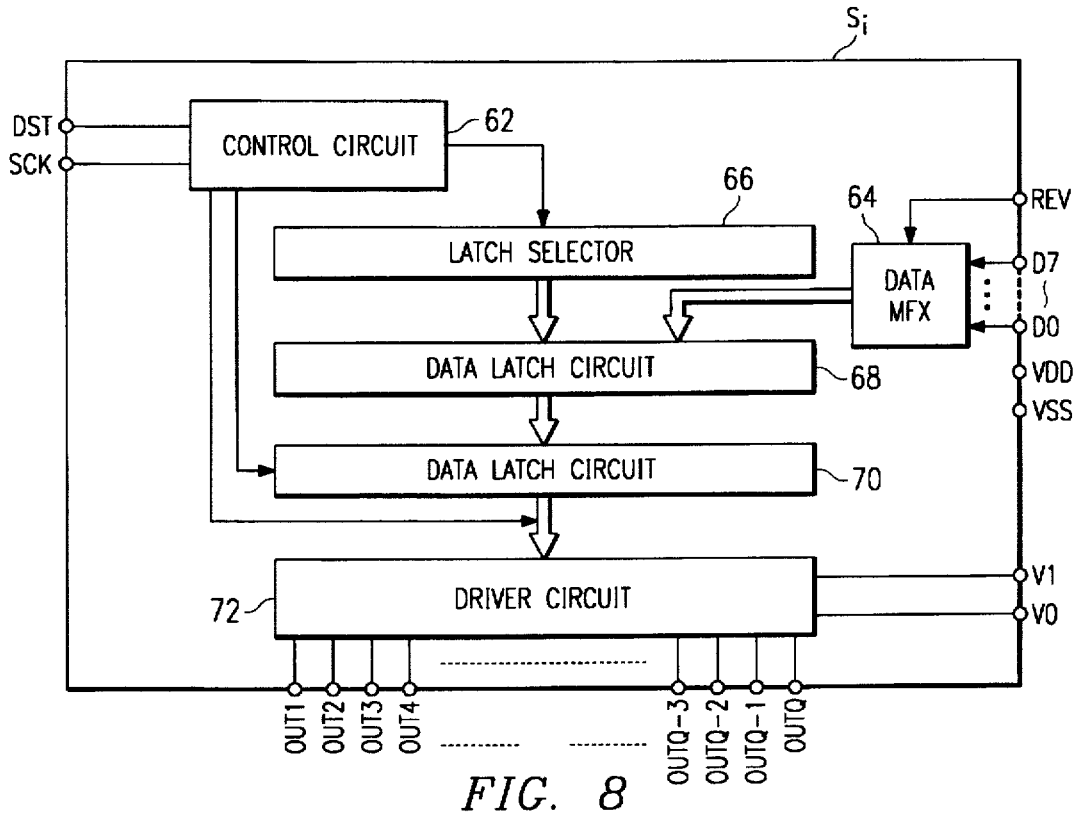
FIG. 8
| REV | 0 | | 1 | |
|---|---|---|---|---|
| INPUT DATA $D_i$ | 0 | 1 | 0 | 1 |
| INTERNAL DATA LATCH $J_i$ | 0 | 1 | 1 | 0 |
| $OUT_i$ | $V_0$ | $V_1$ | $V_1$ | $V_0$ |
FIG. 9
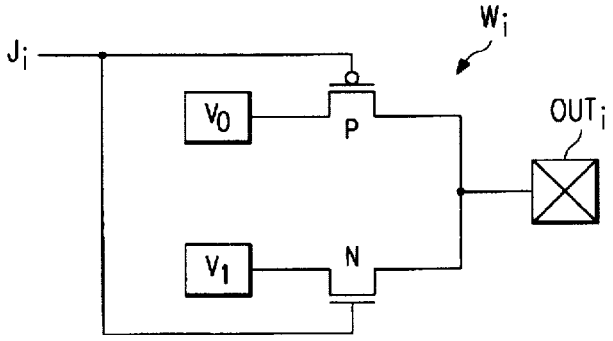
FIG. 10

METHOD AND APPARATUS FOR DRIVING A LIQUID CRYSTAL PANEL

FIELD OF THE INVENTION

This invention relates to a method and device for generating signals for driving a liquid crystal display (LCD) panel.

BACKGROUND OF THE INVENTION

In recent years, flat panel displays have been used as the display units for computers and other display equipment. Among the various types of flat panel displays, the LCD (liquid crystal display) using liquid crystals is the most frequently used. A typical type LCD is the simple matrix LCD panel.

FIG. 13 is a schematic diagram of the simple matrix LCD panel. In this simple matrix LCD panel the liquid crystals are sandwiched between a number of scan electrodes $X_1, X_2, \ldots, X_N$ and a number of signal electrodes $Y_1, Y_2, \ldots Y_M$. Each intersecting point between scan electrode X and signal electrode Y forms a pixel.

For this type of LCD panel, by means of scan driving (time-shared driving), the display signal is sent to the various pixels to form a picture. That is, for each cycle a selection scan voltage is applied to one scan electrode $X_i$; for the various pixels on the scan electrode $X_i$ (the pixels on the selected row), the corresponding display signal (selection signal voltage or non-selection signal voltage) is sent to each pixel by means of signal electrodes $Y_1, Y_2, \ldots Y_M$ to display a row. The scan electrodes $(X_1, X_2, \ldots, X_N)$ are selected or scanned from the top to the bottom, and a scan forms a frame (picture).

However, this type of LCD panel has the disadvantage in that the display uniformity is poor. Let us look at this phenomenon with reference to the display pattern of the black-and-white picture shown in FIG. 14 as an example. In FIG. 14, A, B, C, and D have the same feature in that the pixels on the same scan line (the seventh scan line) are white pixels. However, they are different from each other with respect to the display pattern in the longitudinal (column) direction. That is, column A has a display pattern that is all white; column B has a block-like display pattern in which a large (for example, 20 scan lines) black block (the hatched portion) exists; column C has a repetitive spotty block display pattern which has 7 black blocks set with a 7-scan-line gap (white gap) between them; and column D has a lateral fringe-like display pattern with black and white portions set alternately for every other scan line.

FIG. 15 is a diagram of the waveforms of the voltages applied to the various pixels A, B, C, and D using the conventional frame alternation method. In the frame alternation method, with one frame as a unit, the polarity of the voltages applied to scan electrode X and signal electrode Y is inverted, and the voltage applied to the pixel is also inverted. The variation in the waveform and the frequency of the voltage applied to each pixel almost correspond to the degree of variation in the pixel on each display pattern. Consequently, in the case of the display pattern shown in FIG. 14, the frequency of the waveform of the voltage applied to pixel D is rather high with respect to the frequency of the waveforms of the voltages applied to pixels A, B, and C. However, due to the capacitance of the liquid crystal and the resistance of the electrode, as the frequency rises for the applied voltage, the waveform becomes less sharp as indicated by the dotted line in FIG. 15. Consequently, the effective voltage applied to pixel D during the non-selection interval is lower than that applied to the other pixels. Although the pixel is on (white), the difference in the transmittivity is nevertheless displayed, and pixel D becomes darker than pixels A, B, and C.

FIG. 16 is a diagram of the waveforms of the voltages applied to pixels A, B, C, and D using the conventional line alternation method. In this line alternation method, the polarity of the voltage applied is inverted after every predetermined number of scan lines (for example, 7 scan lines) are driven (selected). Consequently, in the case of the display pattern shown in FIG. 14, corresponding to inversion of the polarity of the applied voltage, the waveform of the voltage applied to each pixel is changed. Consequently, corresponding to the number of the polarity inversions, while the waveforms or frequencies of the voltages applied to pixels A and B increase, the waveform variation or frequency of the voltage applied to pixel D decreases, and the effective voltage difference or difference in transmissivity between the two, that is, (A, and B) and D, decreases. However, on the other hand, for the waveform of the voltage applied to pixel C on the display pattern with black and white portions displayed alternately in the longitudinal (column) direction in a period corresponding to half of the period of the line inversion, the significant number of waveform variation points originally present on it are cancelled by inversion of the polarity, and the effective voltage or transmissivity undesirable increases. As a result, the display nonuniformity cannot be eliminated.

As a means to solve this problem of crosstalk, the following driving method has been proposed: for the first frame, all of the scan electrodes are selected by an applied voltage with the same polarity; for the second frame, the scan electrodes are alternately selected by applied voltages with opposite polarities. In this way, for any display pattern, in two consecutive frames, the waveform variations or frequencies in the non-selection interval are set to be identical. However, in this driving method, as the waveform variation degrees and patterns are significantly different between the first frame and the second frame, flicker occurs, which is disadvantageous.

The purpose of this invention is to solve the problems of the conventional methods by providing a method and device for driving an LCD panel characterized by the fact that it is able to significantly reduce the effective voltage difference of the applied voltage waveform between the different pixels caused by differences in the display pattern, and to suppress the crosstalk without causing flicker or some other problem.

SUMMARY OF INVENTION

In order to realize the purpose, this invention provides a method for driving an LCD panel characterized by the following facts: the method drives an LCD panel with the following configuration: a number of scan electrodes and a number of signal electrodes are arranged such that they cross each other with liquid crystals sandwiched between them; the pixel located at each intersecting point is turned on/off in accordance with the corresponding absolute value of the difference between the voltage applied to the scan electrode and the voltage applied to the signal electrode; after every prescribed number of consecutive scan electrodes, the polarity is inverted for the voltage applied to the scan electrode and the voltage applied to the signal electrode; in an inversion shorter or longer than an alternation period for the inversion of voltage, in a random order that does not pertain to the configuration order, a selection scan voltage is applied to the scan electrode, and, at the same time, corresponding to the scan electrode on which the selection scan voltage is applied, a selection signal voltage or a non-selection signal voltage is applied to each of the signal electrodes.

Also, this invention provides a device for driving an LCD panel characterized by the following facts: the device drives an LCD panel with the following configuration: a number of scan electrodes and a number of signal electrodes are arranged such that them cross each other with liquid crystals sandwiched between them; the pixel located at each intersecting point is turned on/off in accordance with the corresponding absolute value of the difference between the voltage applied to the scan electrode and the voltage applied to the signal electrode; this device for driving the LCD panel has the following means: a scan electrode driving means which, for each cycle, applies a selection scan voltage to one of the scan electrodes and a non-selection scan voltage to all of the other scan electrodes; a signal electrode driving means which, when one of the scan electrodes has the selection scan voltage applied to it, a selection signal voltage or a non-selection signal voltage is applied to each of the signal electrodes based on the image data corresponding to the various pixels on the scan electrode; a line alternation forming means which inverts the polarity of the voltages applied to the scan electrodes and signal electrodes, respectively, after every prescribed number of consecutive scan electrodes; a selection order decision means which determines the order of the scan electrodes to which the selection scan voltage is to be applied in the interval shorter or longer than an alternation period corresponding to inversion of the voltage; a selection order control means which controls the scan electrode driving means appropriately to ensure that the selection scan voltage is applied to the scan electrodes in the order determined by the selection order decision means; and a display control means which controls the signal electrode driving means appropriately to ensure that the pixels on the scan electrode, on which the selection scan voltage is applied in the order determined by the selection order decision means, are turned on/off in accordance with the respective image data.

According to this invention, the line alternation method is adopted. According to this method, the polarity of the voltages applied to the scan electrodes and signal electrodes is inverted for every prescribed number of consecutive scan electrodes; in an interval shorter or longer than the alternation period corresponding to inversion of the voltages, the selection scan voltage is applied to the scan electrodes in an arbitrary order (preferably as a random series) that does pertain to the configuration order, and, at the same time, the selection signal voltage or non-selection signal voltage is applied to each signal electrode corresponding to the scan electrode on which the selection scan voltage is applied. By setting the selection order of the scan lines within an interval shorter or longer than the alternation period randomly, the waveform variation of the voltage applied to the pixel during the non-selection interval on an arbitrary display pattern becomes random, and the effective voltage difference or difference in transmissivity between the different pixels during the non-selection interval can be significantly reduced.

BRIEF DESCRIPTION OF THE DRAWINGS

FIG. 8 is a block diagram of an embodiment of signal electrode driver $S_i$ in signal drive circuit 14.

FIG. 9 is a diagram of the data inversion format inside signal electrode driver $S_i$.

FIG. 10 is a circuit diagram of an embodiment of driver $W_i$ corresponding to 1 line in driver circuit 72 of signal electrode driver $S_i$.

Figure 1:
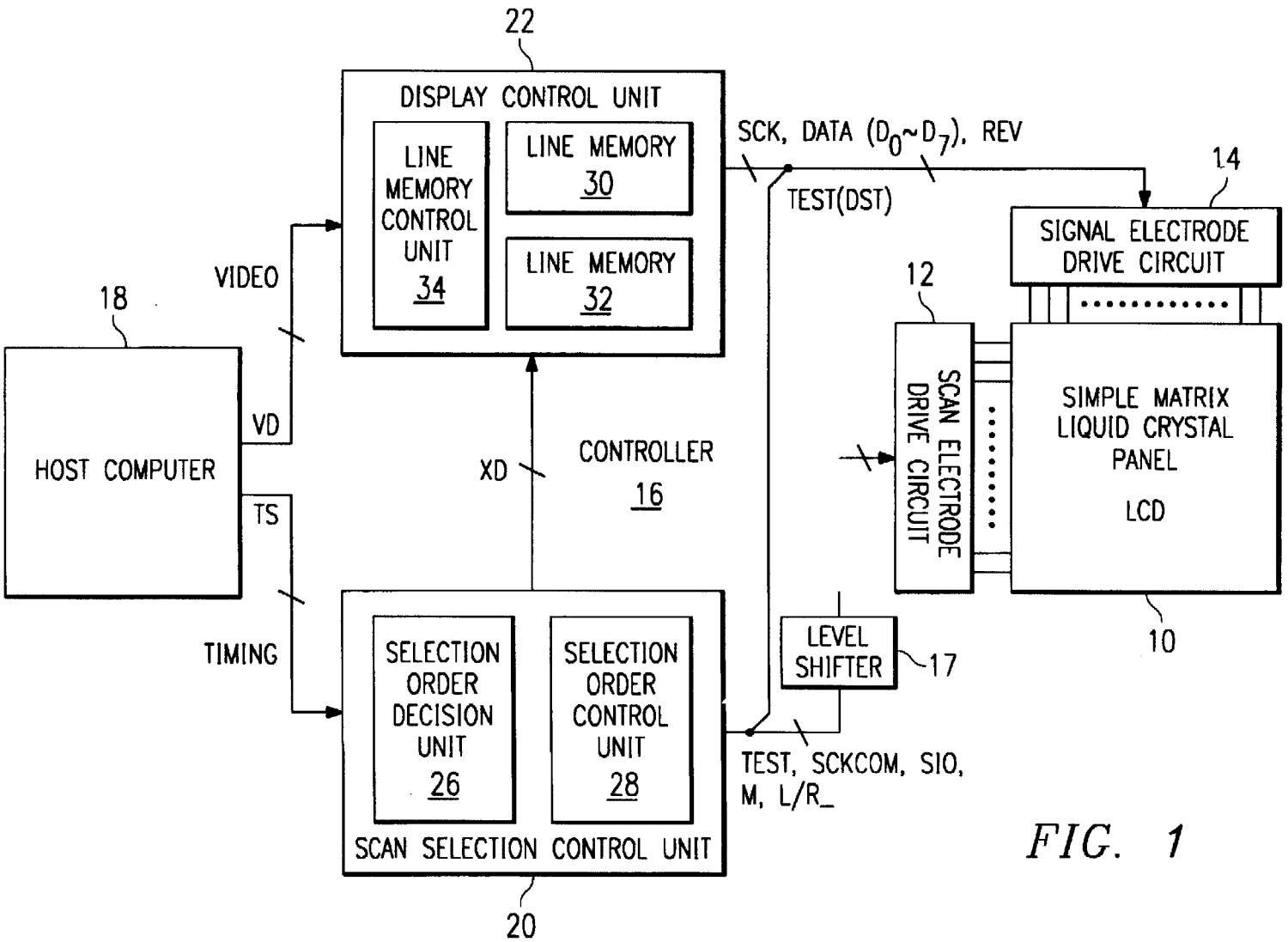
FIG. 1 is a block diagram of a liquid crystal display device using an embodiment of the LCD panel driving method and device of this invention.

More generally, the figures show a simple matrix LCD panel 10, a scan electrode drive circuit 12, a signal electrode drive circuit 14, a controller 16, a scan selection control unit 20, a display control unit 22, line memory 30, 32, a line memory control unit 34, a scan electrode driver $C_i$, a signal electrode driver $S_i$, scan electrodes $X_1, X_2, \ldots, X_N$, and scan electrodes $Y_1, Y_2, \ldots, Y_M$.

DESCRIPTION OF EMBODIMENTS

Figure 13:
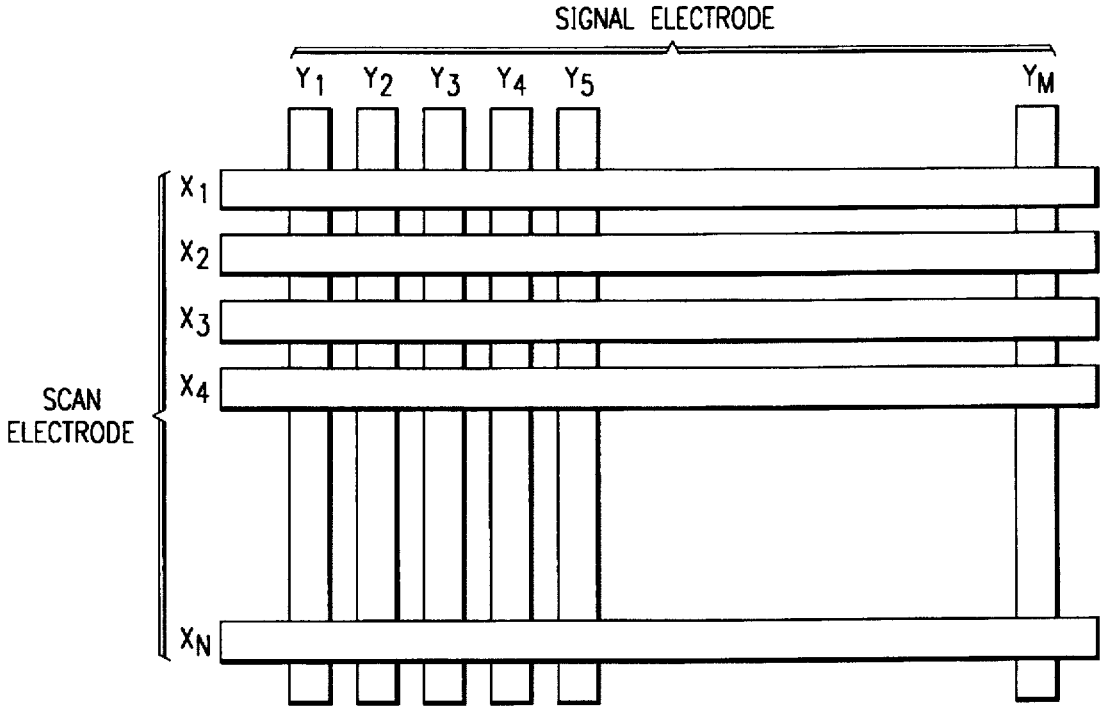
FIG. 13 is a plan view schematically illustrating the configuration of a simple matrix LCD panel.

FIG. 1 is a diagram of the liquid crystal display device using the method and device for driving an LCD panel in an embodiment of this invention. This liquid crystal display device comprises the following parts: a single matrix LCD panel 10 with the same configuration as that shown in FIG. 13; scan electrode drive circuit 12 and signal electrode drive circuit 14 for driving scan electrodes $X_1$–$X_M$ and signal electrodes $Y_1$–$Y_N$ of the LCD panel 10, respectively; controller 16 for controlling the two drive circuits 12 and 14; level shifter 17 for shifting the level of the signal from controller 16 with respect to scan electrode drive circuit 12; and host computer 18 for feeding image data VD and timing signal TS to controller 16.

Controller 16 is made of scan selection control unit 20 and display control unit 22. Scan selection control unit 20 has selection order decision unit 26 and selection order control unit 28, while display control unit 22 has a pair of line memories 30 and 32 and line memory control unit 34. The functions of the various parts in controller 16 will be explained below.

In the following, the 5-level driving method used in the LCD panel in this embodiment will Be explained with reference to FIGS. 2 and 3. Also, for simplification of the explanation, binary display of on/off (white/black) will be assumed for display of liquid crystal panel 10.

Figure 2:
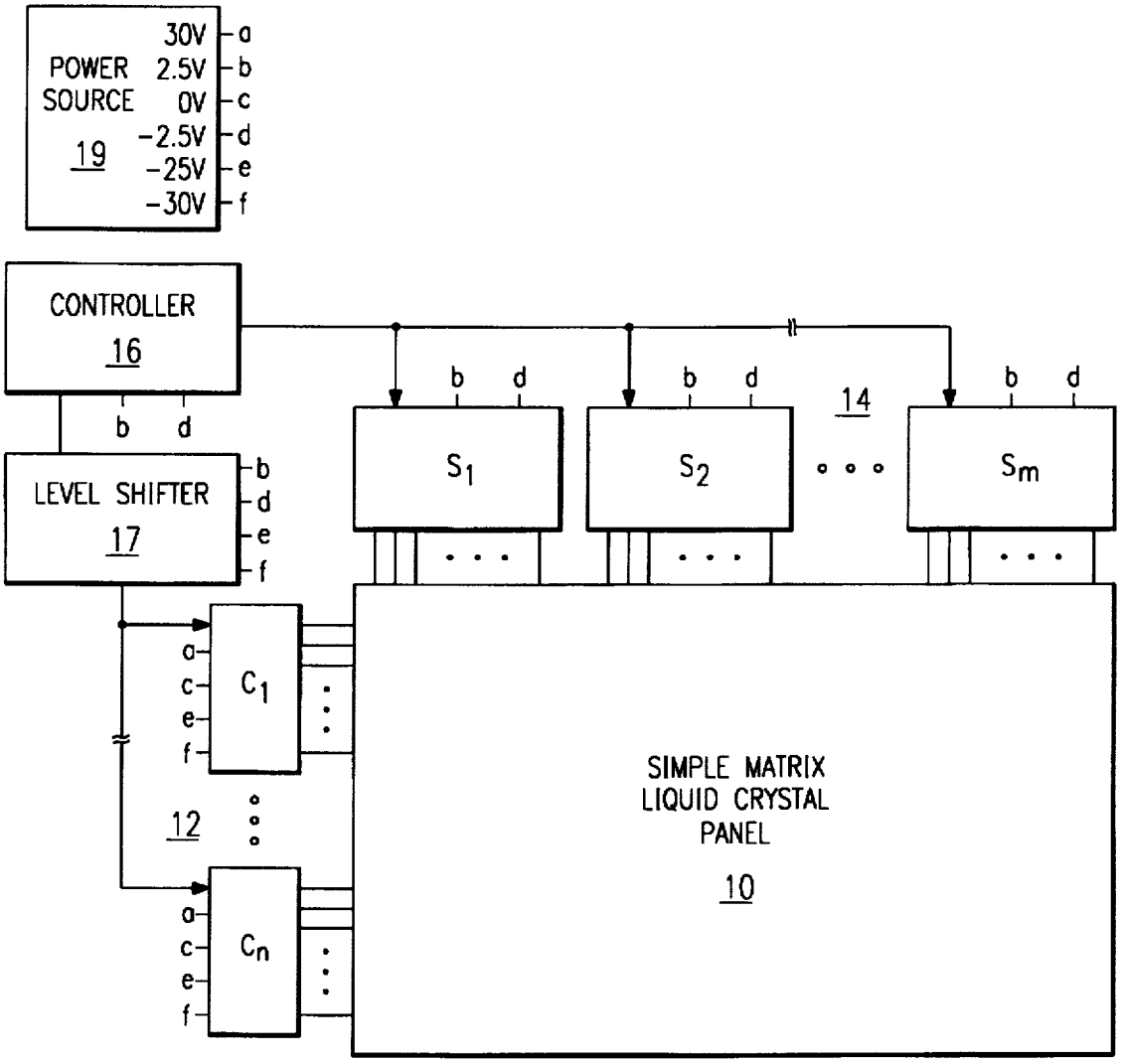
FIG. 2 is a block diagram of a main portion of the driver device for illustrating the 5-level driving method in the embodiment.
Figure 3:
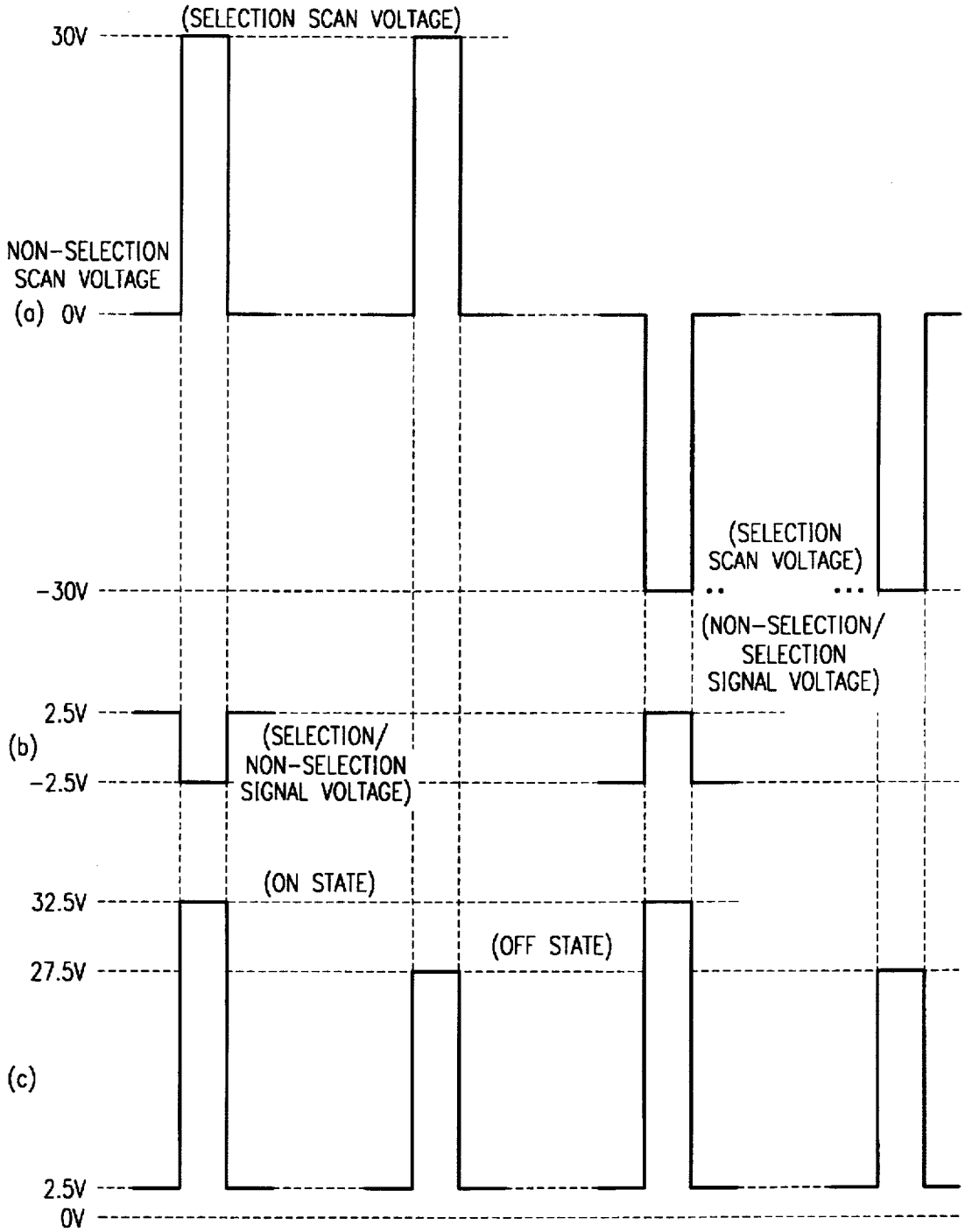
FIG. 3 is a diagram of the voltages levels applied to scan electrode X and signal electrode Y in the 5-level driving method.

As shown in FIG. 2, scan electrode drive circuit 12 is composed of a number of scan electrode drivers $C_1$–$C_n$ connected in parallel to scan electrodes $X_1$–$X_N$ of LCD panel (10), while signal electrode drive circuit 14 is composed of a number of signal electrode drivers $S_1$–$S_m$ connected in parallel to signal electrodes $Y_1$–$Y_M$ of LCD panel 10. When there are 480×1920 pixels on LCD panel 10, each scan electrode drive circuit 12 is composed of three scan electrode drivers $C_1$–$C_3$, each of which has 160 channels of output. On the other hand, each signal electrode drive circuit 14 is composed of twelve signal electrode drivers $S_1$–$S_{12}$, each of which has 160 channels of output.

The data output from controller 16 to level shifter 17 and signal electrode driver $S_i$ are signals with a logic amplitude in the range of −2.5 V to 2.5 V. The data output from level shifter 17 to scan electrode driver $C_i$ are signals with a logic amplitude in the range of −30 V to −25 V. That is, level shifter 17 can convert the signal with a logic amplitude in the range of −2.5 V to 2.5 V to a signal with a logic amplitude in the range of −30 V to −25 V. Power source circuit 19 supplies voltages of 30 V, 0 V, −25 V, and −30 V to scan electrode driver $C_i$, and it supplies voltages of −2.5 V and 2.5 V to signal electrode driver $S_i$.

If a liquid crystal material is under DC driving, as the ions shift to one side, the liquid crystal material quickly degrades. In order to prevent this problem, AC driving is needed. In the 5-level driving method in this embodiment, as shown in FIG. 3(*a*), there are two selection scan voltages for scan electrodes X, that is, 30 V and −30 V. On the other hand, there is only one non-selection scan voltage of 0 V for scan electrodes X. As shown in FIG. 3(*b*), there are two voltages applied to signal electrodes Y, that is, −2.5 V and 2.5 V. However, they become selection voltage (pixel on) or non-selection voltage (pixel off) corresponding to the voltage applied to the corresponding scan electrode X.

When the selection scan voltage of scan electrode X is 30 V, the selection scan voltage of signal electrode Y is −2.5 V. When the selection scan voltage of scan electrode X is −30 V, the selection signal voltage of signal electrode Y is 2.5 V. Consequently, as shown in FIG. 3(*c*), a voltage of 32.5 V is applied to the pixel located at the intersecting point between scan electrode X and signal electrode Y, and the pixel is turned on. On the other hand, when the selection scan voltage of scan electrode X is 30 V, the non-selection signal voltage of signal electrode Y is 2.5 V; when the selection scan voltage of scan electrode X is −30 V, the non-selection signal voltage of signal electrode Y is −2.5 V. Consequently, as shown in FIG. 3(*c*), a voltage of 27.5 V is applied to the corresponding pixel, and the corresponding pixel is turned off. Also, when the non-selection scan voltage of 0 V is applied to each scan electrode X, the voltage applied to each signal electrode is 2.5 V or −2.5 V. Consequently, a voltage of 2.5 V is applied to the various pixels of each scan electrode X that is not selected, and the corresponding pixels are kept off.

In this way, by using the 5-level driving method, only three types of voltages applied to scan electrodes X of LCD panel 10 are sufficient, and only two types of voltages applied to signal electrodes Y are sufficient. Consequently, it is possible to simplify the configuration and control of scan electrode driver $C_i$ and signal electrode driver $S_i$. In particular, in signal electrode driver Si, since its circuit is simply a 5-V circuit, the area of the IC chip can be made smaller, and the cost of the driver can be reduced, which is advantageous.

As shown in FIG. 1, in selection order control unit 28 of scan selection control unit 20, in order to perform the line alternation as in the conventional method, such as seven-line alternation, a line alternation signal M is generated. This signal M is sent to scan electrode drive circuit 12. In selection order decision unit 26, the order of scan electrodes X for application of the selection scan voltage (30 V or −30 V) in an inversion of, for embodiment, one period of alternation as defined by line alternation signal M, is determined by a random number. For embodiment, when seven-line alternation is performed, 14 scan lines are contained in the interval of 1 period of alternation. Consequently, a random number generator that can generate a random series made of 14 consecutive integers may be used.

The conventionally adopted random number generating method is the mixed congruence method. In this mixed congruence method, the following formula is used for operation to generate random numbers in the range of $0$–$2^P-1$ (where P is a natural number).

$$X_{n+1} \equiv aX_n + b \text{ (modulo } 2^P\text{)}, \; X_0 \equiv \tag{1}$$

Note that a, b, $c=1-2^P-1$ (integer); thus $a \equiv 1$ (modulo 4) and $b=1$ (modulo 2).

For embodiment, suppose P=4, a, b, and c take the following values:

a=1, 5, 9, 13 (4 values)

b=1, 3, 5, 7, 9, 11, 13, 15 (8 values)

c=0, 1, 2, . . . , 15 (16 values)

There are 4×8×16=512 combinations for a, b, and c. Consequently, it is possible to generate a total of 512 random series $\{X_0, X_1, \ldots, X_{15}\}$ made of integers in the range of 0–15.

When a random series made of 14 consecutive integers with A as the initial value is to be formed, first of all, a random series $\{X_0, X_1, \ldots, X_{15}\}$ made of integers of 0–15 as explained above is formed. Then, two prescribed integers (such as 14 and 15) are removed from the random series $\{X_0, X_1, \ldots, X_{15}\}$, and the initial value (base value) A is added to the remaining random series made of 13 integers.

In selection order decision unit 26, as the operation is performed, it is possible to use the random series to determine the selection order of the 14 scan lines within one period of alternation by seven-line alternation.

Data XD of the scan selection order determined by selection order decision unit 26 is sent to selection order control unit 28 in scan selection control unit 20, and, at the same time, is also sent to line memory control unit 34 of display control unit 22.

By means of selection order control unit 28, control or timing signals TEST, SCKCOM, SIO, and L/R– for applying the selection scan voltage to scan electrodes X in the order determined by selection order decision unit 26 are sent to scan electrode drive circuit 12, and, at the same time, timing signal TEST (DST) is also sent to signal electrode drive circuit 14.

By means of line memory control unit 34 of display control unit 22, control is appropriately carried out so that the write operation and read operation of two line memories 30 and 32 are alternately carried out. That is, by means of line memory control unit 34, the operations of two line memories 30 and 32 are controlled appropriately to ensure that while the image data is read from one line memories (for embodiment, line memory 30), the image data from host computer 18 to the other line memory (such as line memory 32).

In this embodiment, when the seven-line alternation is performed, within one period of the alternation, 14 scan lines of image data are written as a block into each line memory 30 and 32. When 1 block of image data is read from each of line memories 30 and 32, in an order determined by selection order decision unit 26, image data DATA corresponding to a scan line is read 8 bits ($D_0$–$D_7$) at a time, and is sent to signal electrode drive circuit 14 together with SCK and REV.

Figure 4:
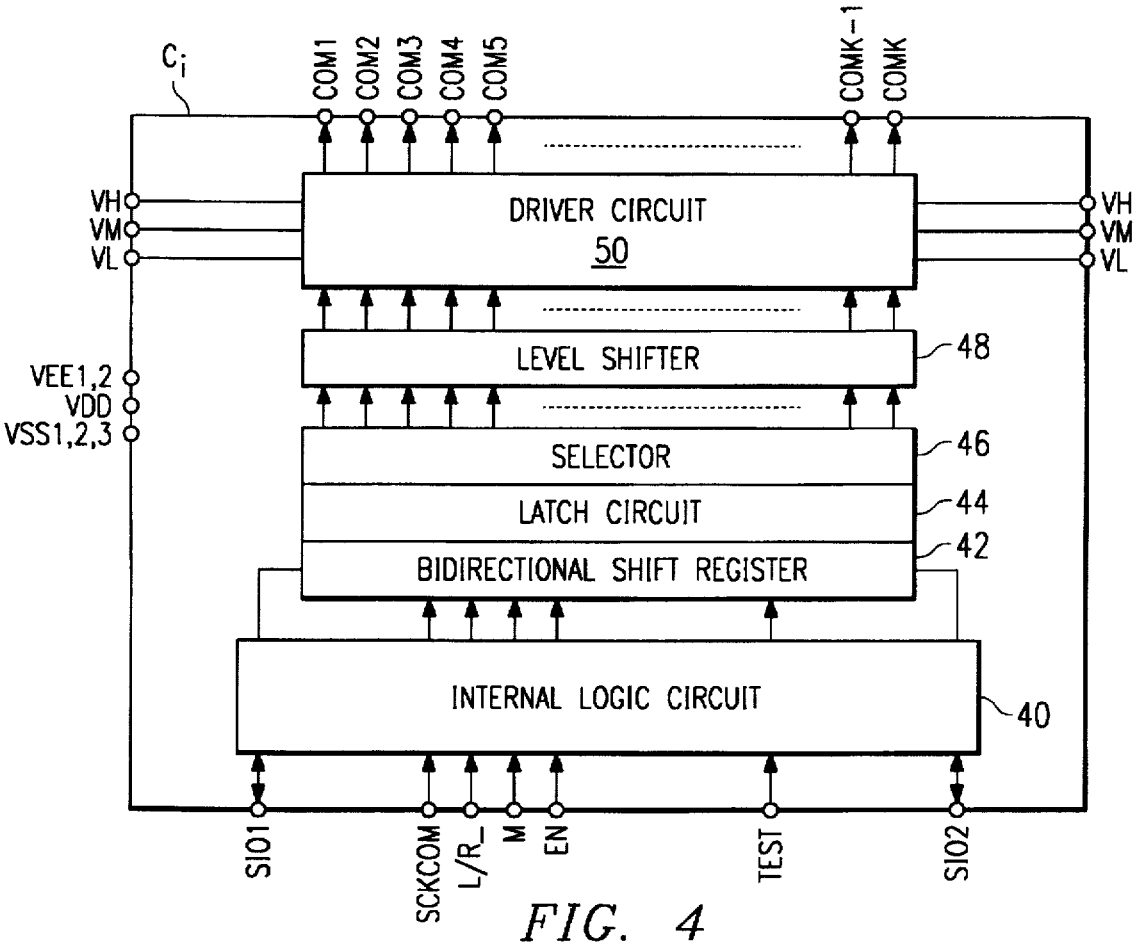
FIG. 4 is a block diagram of an embodiment of a scan electrode driver $C_i$ in the scan electrode drive circuit 12 of FIG. 1.

FIG. 4 is a diagram of an embodiment of each scan electrode driver $C_i$ within scan electrode drive circuit 12. This scan electrode driver $C_i$ includes an IC containing internal logic circuit 40, bidirectional shift register 42, latch circuit 44, selector 46, level shifter 48, and driver circuit 50. Among the terminals of the IC, serial data input/output terminals $SIO_1$ and $SIO_2$, shift clock terminal SCKCOM, shift direction control terminal L/R–, alternation signal input terminal M, liquid crystal driving output control terminal EN, and test input terminal TEST are connected through level shifter 17 to scan selection control unit 20 of controller 16. Power source terminals $V_H$, $V_M$, and $V_L$ for driving the liquid crystal are connected to power source circuit 19 (FIG. 2).

In this embodiment, $V_H$, $V_M$, and $V_L$ are 30 V, 0 V, and –30 V, respectively. Also, high-voltage-rating type power source terminals $V_{EE1,2}$ and $V_{SS1,2}$ as well as internal logic type power source terminals $V_{DD}$ and $V_{SS3}$ are connected to power source circuit 19 (FIG. 2). Liquid crystal driving output terminals $COM_1$, $COM_2$, . . . , $COM_K$ are connected to scan electrodes $X_{H+1}$, $X_{H+2}$, . . . , $X_{H+K}$, respectively, and driven by a scan electrode driver $C_i$. Internal logic circuit 40 controls the operation of the various parts corresponding to the control or timing signals SIO, SCKCOM, L/R–, M, EN, and TEST from scan selection control unit 20.

Figure 5:
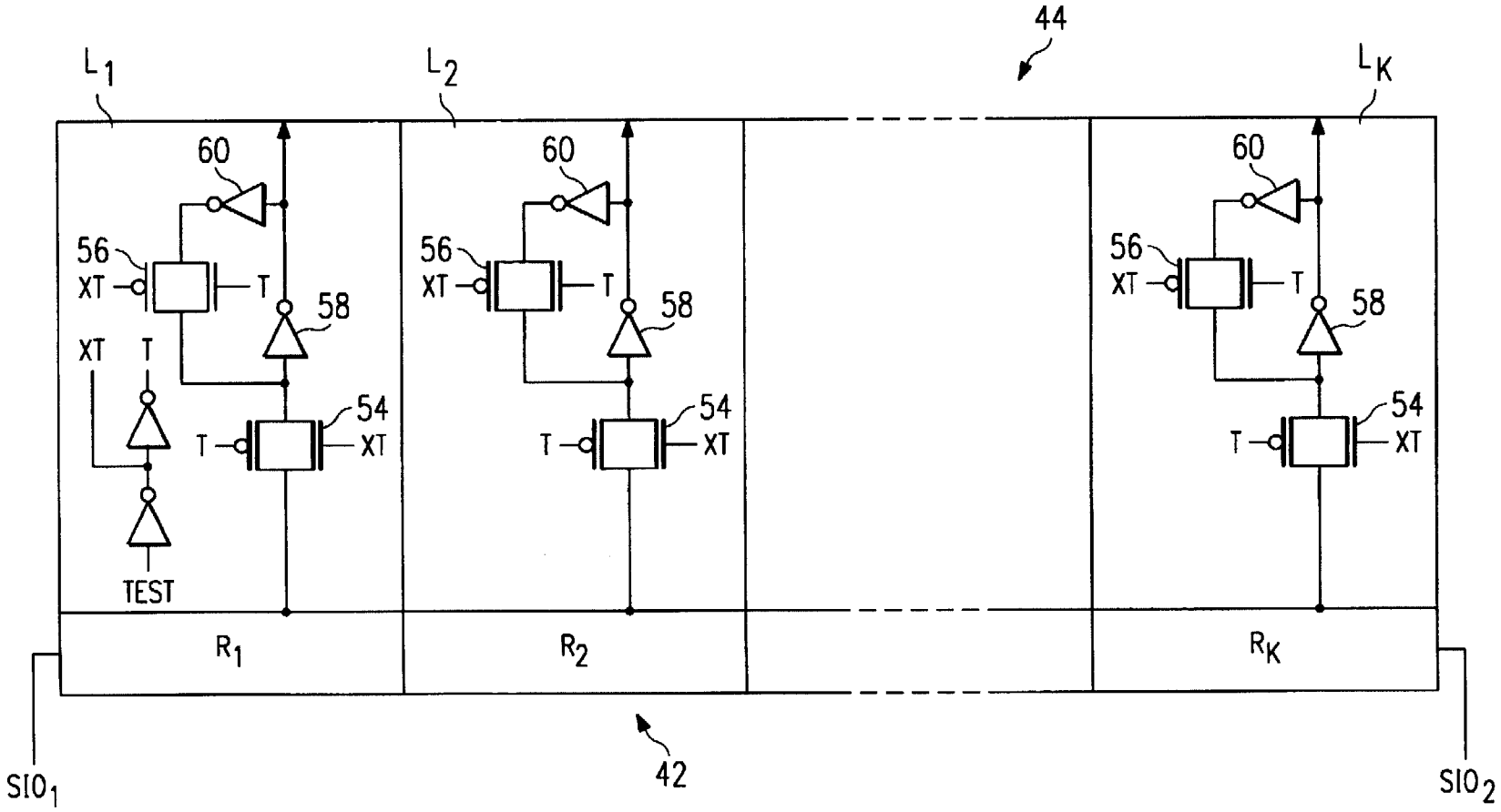
FIG. 5 is a block diagram of an embodiment of a bidirectional transistor 42 and latch circuit 44 in the scan electrode driver $C_i$ of FIG. 4.

FIG. 5 is a diagram of an embodiment of configuration of bidirectional shift register 42 and latch circuit 44. In bidirectional shift register 42, liquid crystal driving output terminals $COM_1$, $COM_2$, . . . $COM_K$ are connected in series to the corresponding number of registers $R_1$, $R_2$, . . . , $R_K$; from serial data input/output terminal $SIO_1$ or $SIO_2$, 1 pulse of data SIO is input; for each falling edge of shift clock SCKCOM, corresponding to the state of shift direction control signal L/R–, shift register data SIO is shifted by 1 bit (register) to the left side or right side in the shift register, in this configuration.

Latch circuit 44 comprises a number of (K) latches $L_1$, $L_2$, . . . , $L_K$ connected to registers $R_1$, $R_2$, . . . , $R_K$ of shift register 42, respectively. In this circuit, while test signal TEST is latched to the L level, latches $L_1$, $L_2$, . . . , $L_K$ fetch the data from the corresponding registers $R_1$, $R_2$, . . . , $R_K$, respectively. On the other hand, when test signal TEST is on the H level, latches $L_1$, $L_2$, . . . , $L_K$ latch (hold) the fetched data, respectively, in this configuration.

As shown in FIG. 5, each latch $L_i$ is made of two transfer gates 54 and 56 and two inverters 58 and 60. When TEST is on the L-level, the data through state is reached, with first transfer gate 54 on and second transfer gate 56 off. When TEST is on the H level, the data latch state is reached, with first transfer gate 54 off and second transfer gate 56 on.

Figure 6:
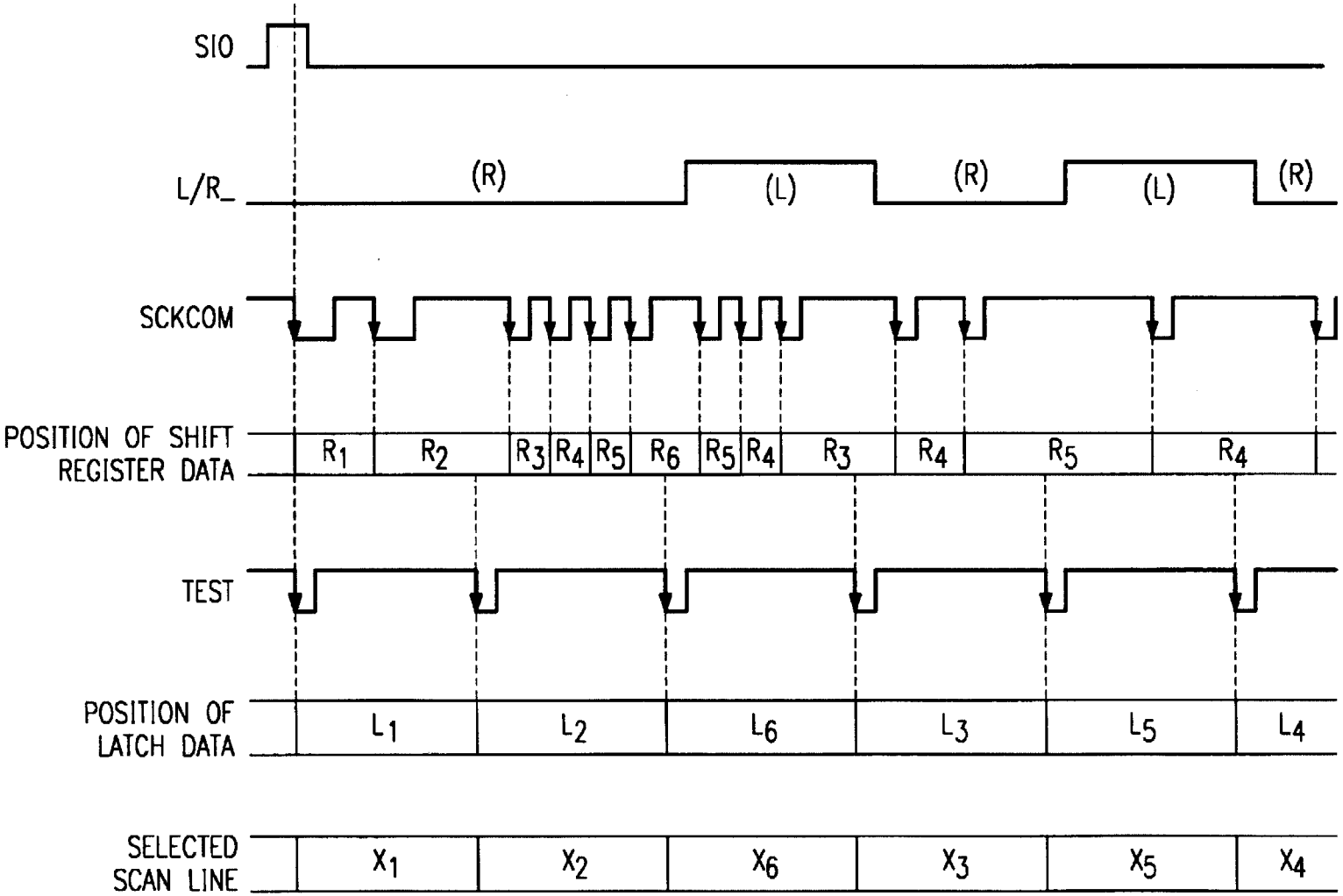
FIG. 6 is a timing diagram of the operation of bidirectional transistor 42 and latch circuit 44 of FIG. 5.

FIG. 6 is a diagram of the timing of the operation of bidirectional shift register 42 and latch circuit 44. In this embodiment, as explained above, within a period of alternation, 14 scan lines are selected (driven) in the order determined by random numbers that do not pertain to the configuration order. FIG. 6 shows an embodiment, in which the 14 scan lines {$X_1$, $X_2$, . . . , $X_{14}$} are selected in the order of $X_1$, $X_2$, $X_6$, $X_3$, $X_5$, $X_4$, . . . .

First of all, when shift direction control signal L/R– is on the L level and indicates the right shift (R), 1 pulse of shift register data SIO is fed from the left-side shift register data input terminal $SIO_1$, and, at the same time, shift clock SCKCOM and test signal TEST fall from the H level to the L level. In this manner, shift register data SIO is loaded into first register R1, and, at the same time, is sent to first latch $L_1$. Immediately after that, TEST resets on the H level, and shift register data SIO is latched in first latch $L_1$.

Then, before TEST falls to the L level, shift clock SCKCOM falls once. In this case, as shift direction control Signal L/R– is still on the L level (indicating a right shift), corresponding to the falling edge of SCKCOM, in shift register 42, data SIO is shifted from first register $R_1$ to second register $R_2$. As TEST falls to the L level in this state, shift register data SIO contained in second register $R_2$ is fetched into second latch $L_2$. Immediately after that, as TEST resets to the H level, shift register data SIO in second latch $L_2$ is latched.

Then, before TEST falls to the L level, while shift direction control signal L/R– remains on the L level (indicating a right shift), shift clock SCKCOM falls for 4 cycles. In this way, data SIO in register 42 is shifted to the right by 4 bits to the sixth register $R_6$. Then, as TEST falls to the lower level, shift register data SIO contained in sixth register $R_6$ is fetched into sixth latch $L_6$. Immediately after that, TEST resets to the H level, and shift register data SIO is latched in sixth latch $L_6$.

Then, before TEST falls to the L level, shift direction control signal L/R– is switched to the H level (indicating a left shift), and shift clock SCKCOM falls for three cycles. In this way, data SIO in shift register 42 is shifted 3 bits to the left to the third register $R_3$. Then, as TEST falls to the L level, shift register data SIO is fetched from the third register $R_3$ to the third latch $L_3$. Immediately after that, as TEST resets to the H level, shift register data SIO is latched in the third latch $L_3$.

In this way, during a TEST period, by means of shift direction control signal L/R–, while the instruction of the shift direction is received, shift clock SCKCOM falls for a prescribed number of cycles. In this way, in each TEST period, shift register data SIO is latched in the prescribed latch $L_i$ (in the prescribed order), and the desired (in the prescribed order) scan electrode Xi corresponding to the latch is selected (driven).

Also, suppose the TEST period is set at 50 μsec, the period of SCKCOM is selected at about 0.1 μsec. In this way, during a TEST period, it is possible to move shift register data SIO to any register position in shift register (42).

As shown in FIG. 4, selector 46 outputs control signals $V_{GH}$, $V_{GM}$, and $V_{GL}$ to be explained below for controlling drivers $DRV_1$, $DRV_2$, . . . , $DRV_K$ in driver circuit 50 corresponding to the various latch outputs from latch circuit 44 and the logic state of the line alternation signal M from internal logic circuit 40. Level shifter 48 performs the shift operation to transform the amplitude voltage levels of control signals $V_{GH}$, $V_{GM}$, $V_{GL}$ from selector 46 from, for embodiment, the range of –30 V to –25 V, to, for embodiment, the range of –30 V to 30 V.

Figure 7:
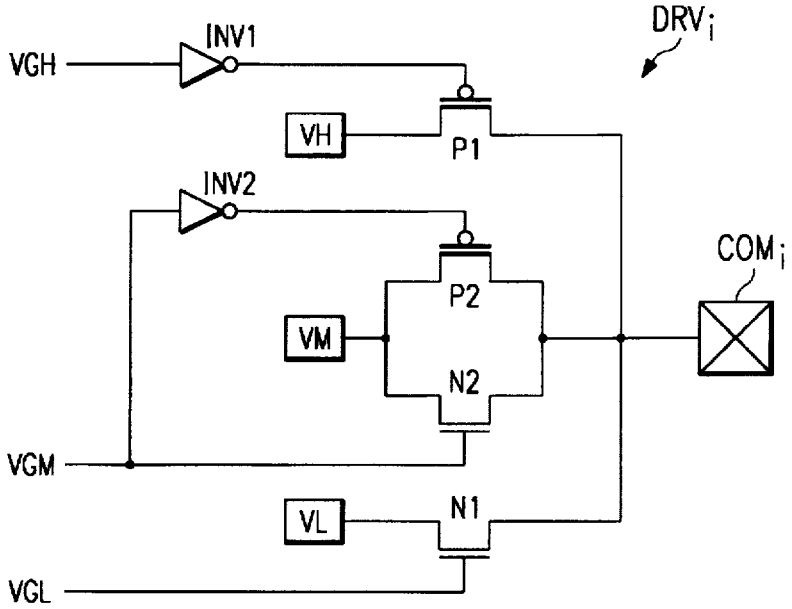
FIG. 7 is a circuit diagram of an embodiment of driver $DRV_i$ for 1 line in driver circuit 50 of each scan electrode driver $C_i$.

FIG. 7 is a diagram of an embodiment of the circuit of driver $DRV_i$ in driver circuit 50. This driver $DRV_i$ comprises p-channel MOS transistors $P_1$ and $P_2$, n-channel MOS transistors $N_1$ and $N_2$, and inverters $INV_1$ and $INV_2$. In this configuration, by means of control signals $V_{GH}$, $V_{GM}$, and $V_{GL}$, conduction of each transistor is controlled, and one of three voltage levels $V_H$, $V_M$, and $V_L$ is output to output pad $COM_i$ of the IC chip (scanning electrode driver $C_i$). Each transistor is a high-voltage-rating transistor. In this embodiment, voltages $V_H$, $V_M$, and $V_L$ are set at 30 V, 0 V, and −30 V, respectively. However, it is also possible to select other voltages. Also, control signals $V_{GH}$, $V_{GM}$, and $V_{GL}$ from level shifter 48 are used to control conduction of the various transistors by means of two voltage levels of 30 V (logic level H) or −30 V (logic level L).

In this driver $DRV_i$, when control signal $V_{GH}$ is at logic level H and control signals $V_{GM}$ and $V_{GL}$ are at logic level L, only transistor $P_1$ is conductive, and voltage $V_H$ is output through transistor $P_1$ and output pad $COM_i$ to scan electrode $X_i$. When control signal $V_{GM}$ is at logic level H, while control signals $V_{GH}$ and $V_{GL}$ are at logic level L, only transistors $P_2$ and $N_2$ are conductive, and voltage $V_M$ is output through output pad $COM_i$ to scan electrode $X_i$. When control signal $V_{GL}$ is at logic level H, while control signals $V_{GH}$ and $V_{GM}$ are at logic level L, only transistor $N_2$ is conductive, and voltage $V_L$ is output through transistor N2 and output pad $COM_i$ to scan electrode $X_i$.

FIG. 8 is a diagram of an embodiment of signal electrode driver $S_i$ in signal electrode drive circuit 14. This signal electrode driver $S_i$ is an IC containing control circuit 62, data multiplexer 64, latch selector 66, data latch circuits 68 and 70, and driver circuit 72. Among the terminals of the IC, parallel data input/output terminals $D_0$–$D_7$, data inversion control terminal REV, and clock terminal SCK are connected to display control unit 22 of controller 16, and data latch terminal DST (TEST) is connected to scan selection control unit 20 of controller 16. Liquid crystal driving power source terminals $V_0$ and $V_1$, and internal logic power source terminals $V_{DD}$ and $V_{SS}$ are connected to power source circuit 19 (FIG. 2).

In this embodiment, $V_0$ and $V_1$ are set to 2.5 V and −2.5 V, respectively, and $V_{DD}$ and $V_{SS}$ are also set to 2.5 V and −2.5 V, respectively. Liquid crystal driving output terminals $OUT_1, OUT_2, \ldots, OUT_Q$ are connected to signal electrodes $Y_{J+1}, Y_{J+2}, \ldots, Y_{J+Q}$, respectively, corresponding to the portion driven by signal driver $S_i$.

In this signal electrode driver $S_i$, the 8-bit-unit image data $D_0$–$D_7$ fed from display control unit 22 of controller 16 is input to data multiplexer 64, and is then stored in data latch circuit 68. In data multiplexer 64, the logic level input data $D_i$ is conditionally inverted depending on the logic level of data inversion signal REV corresponding to the logic level of line alternation signal M.

FIG. 9 shows the format. That is, when the logic level of REV is 0, the logic levels of input data $D_i$ are not inverted, and $V_1$ (−2.5 V) appears as the selection signal voltage, while $V_0$ (2.5 V) appears as the non-selection signal voltage on liquid crystal driving output terminals $OUT_i$. When the logic level of REV is 1, the logic levels of input data $D_i$ are inverted, and $V_0$ (2.5 V) appears as the selection signal voltage, while $V_1$ (−2.5 V) appears as the non-selection signal voltage on liquid crystal driving output terminals $OUT_i$.

In first data latch circuit 68, under control of latch selector 66, 8-bit-unit data $D_0$–$D_7$ is latched in N-group units (here Q=8×N). In second data latch circuit 70, Q data $J_i$ is latched in parallel, and data $J_i$ corresponding to the fall of data latch signal DST (TEST) is sent as a control signal to drivers $W_i$ in driver circuit 72.

FIG. 10 is a diagram of an embodiment of the circuit configuration of driver $W_i$ in driver circuit 72. The driver $W_i$ is made of n-channel MOS transistor N and p-channel MOS transistor P. By means of the control signal from data latch circuit 70 (display signal $J_i$), conduction of each transistor is controlled, and one of the two voltage levels $V_1$ and $V_0$ is output to output pad $OUT_i$ of the IC chip (signal electrode driver $S_i$) in this configuration. Each transistor is a 5-V transistor. In this case, voltages $V_0$ and $V_1$ are 2.5 V and −2.5 V, respectively. However, other voltages may also be adopted. Also, control signal $J_i$ from data latch circuit 70 controls conduction of each transistor by means of the two voltage levels of 2.5 V (logic level H) or −2.5 V (logic level L).

In the driver $W_i$, when control signal $J_i$ is to logic level H, only transistor N is conductive, and voltage $V_1$ is output through the transistor N and output pad $OUT_i$ to signal electrode $Y_i$. When control signal $J_i$ is at logic level L, only transistor P is conductive, and voltage $V_0$ is output through the transistor P and output pad $OUT_i$ to signal electrode $Y_i$. As explained above, because the line alternation method is adopted in this embodiment, the logic of output voltage $V_1/V_0$ (selection signal voltage/non-selection signal voltage) depends on the logic level of the line alternation signal M, that is, the logic level of the data inversion control signal.

Figure 11:
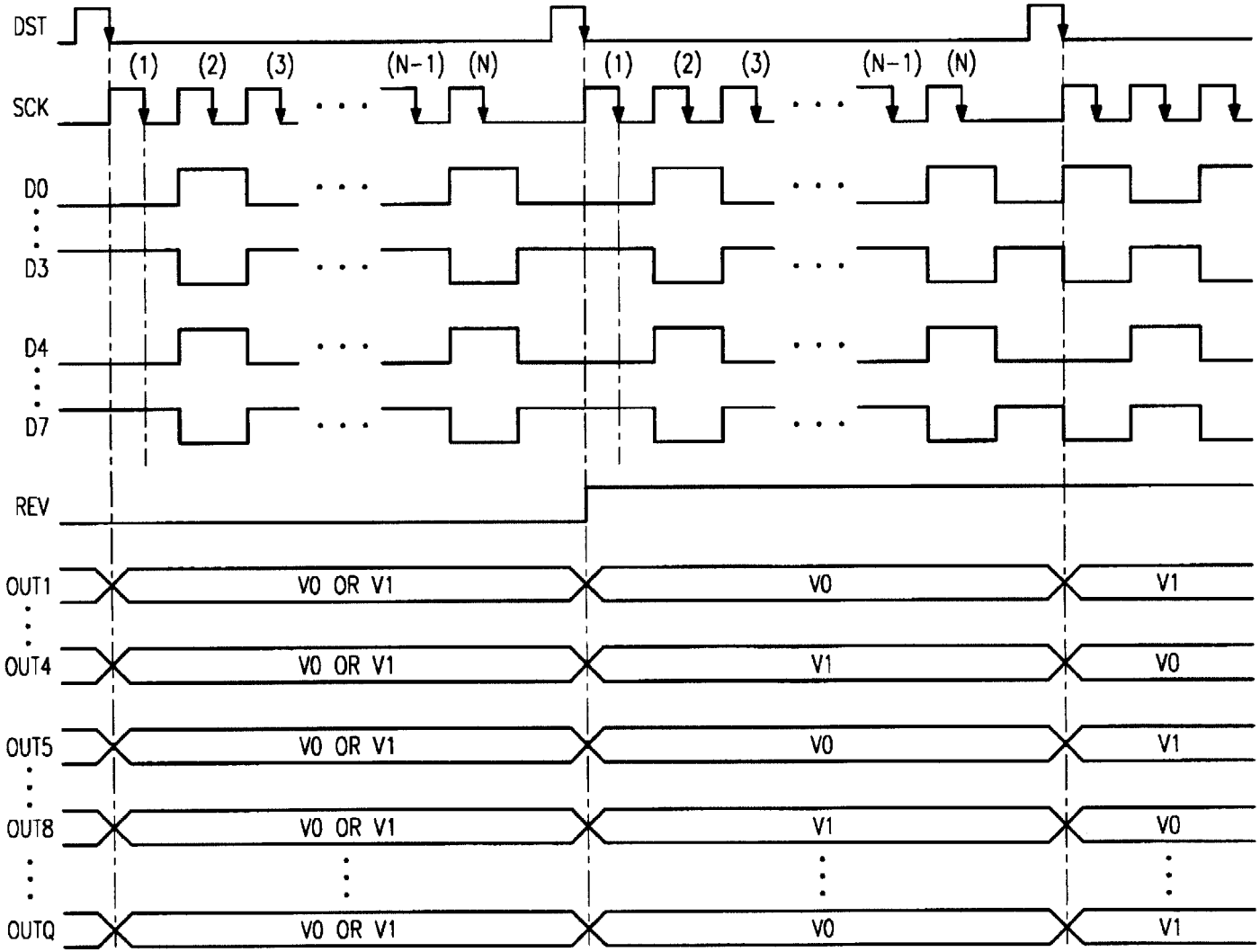
FIG. 11 is a timing diagram of the operation in signal electrode driver $S_i$.

FIG. 11 is a diagram of timing of the operation in signal electrode driver $S_i$. During one DST period, image data $D_0$, $D_1, \ldots$ is fetched in 8-bit units N times (total Q units). In the next interval of one DST period, the output voltage ($V_1$ or $V_0$) corresponding to the logic level of image data $D_0$, $D_1$, ... and the logic level of data inversion control signal REV is output to liquid crystal driving output terminal $OUT_i$.

As explained above, in the LCD panel driving device in this embodiment, according to the line alternation method, the polarity of the voltage applied to each scan electrode X and signal electrode Y is inverted for every prescribed number (for embodiment, 7) consecutive scan electrodes; during one period of alternation with inversion made for the voltage, the selection scan voltage is applied to scan electrode X in an arbitrary order determined by a random number that does not pertain to the configuration order, and, at the same time, corresponding to scan electrode $X_i$ with the selection scan voltage applied to it, the selection signal voltage or non-selection signal voltage is applied to signal electrodes $Y_1$–$Y_M$.

In this way, for embodiment, as the selection order of the scan lines within one period of alternation is set randomly, the variation in the waveform of the voltage applied to the pixel during the non-selection interval in an arbitrary display pattern becomes random, and the difference in the effective voltage or the difference in the transmissivity can be effectively decreased.

Figure 12:
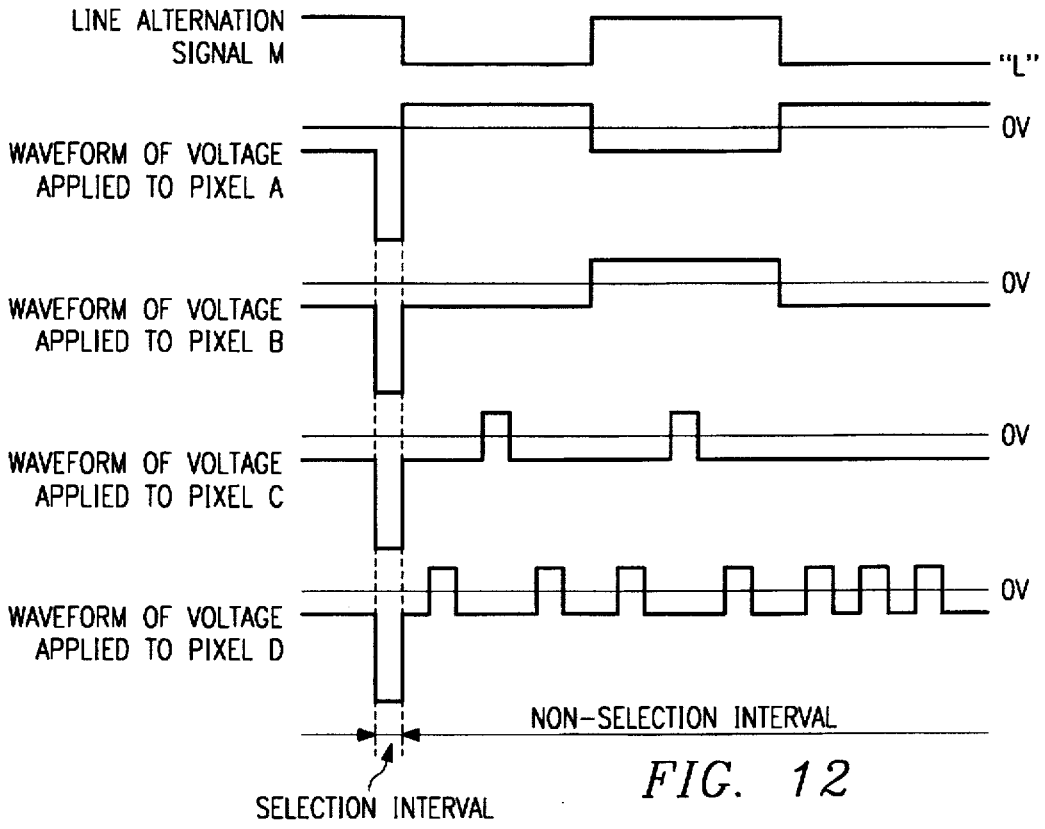
FIG. 12 is a diagram of an embodiment of the applied voltage waveform in the embodiment with respect to pixels A, B, C, and D.
Figure 14:
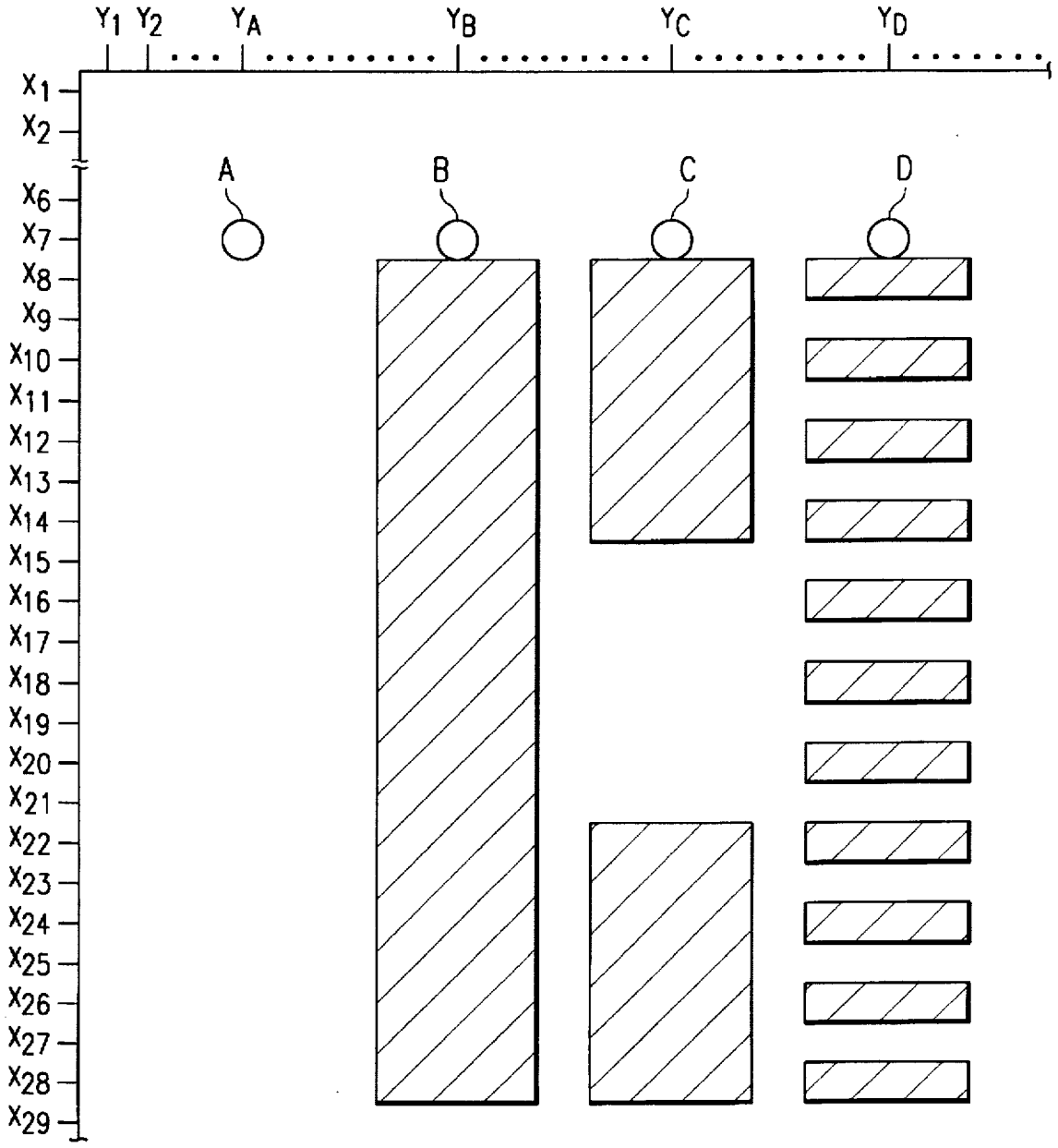
FIG. 14 is a diagram of the display pattern for explaining the crosstalk phenomenon on the simple matrix LCD panel.
Figure 15:
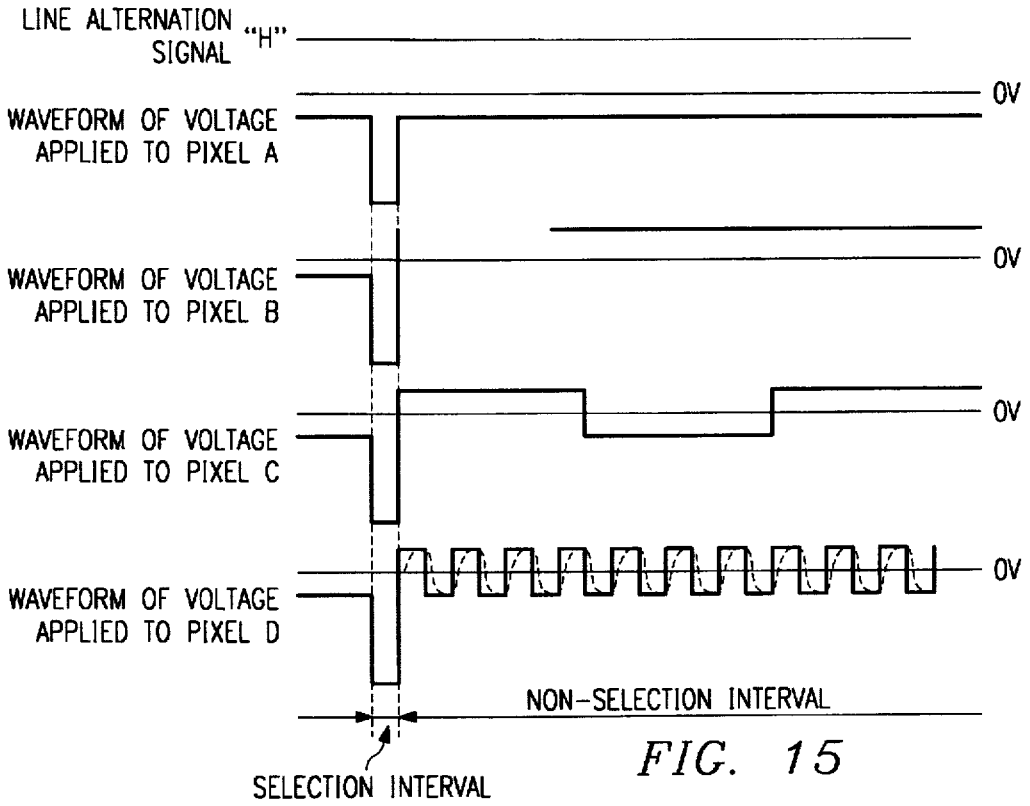
FIG. 15 is a diagram of the waveforms of the applied voltage in a conventional frame alternation method with respect to pixels A, B, C, and D shown in FIG. 14.
Figure 16:
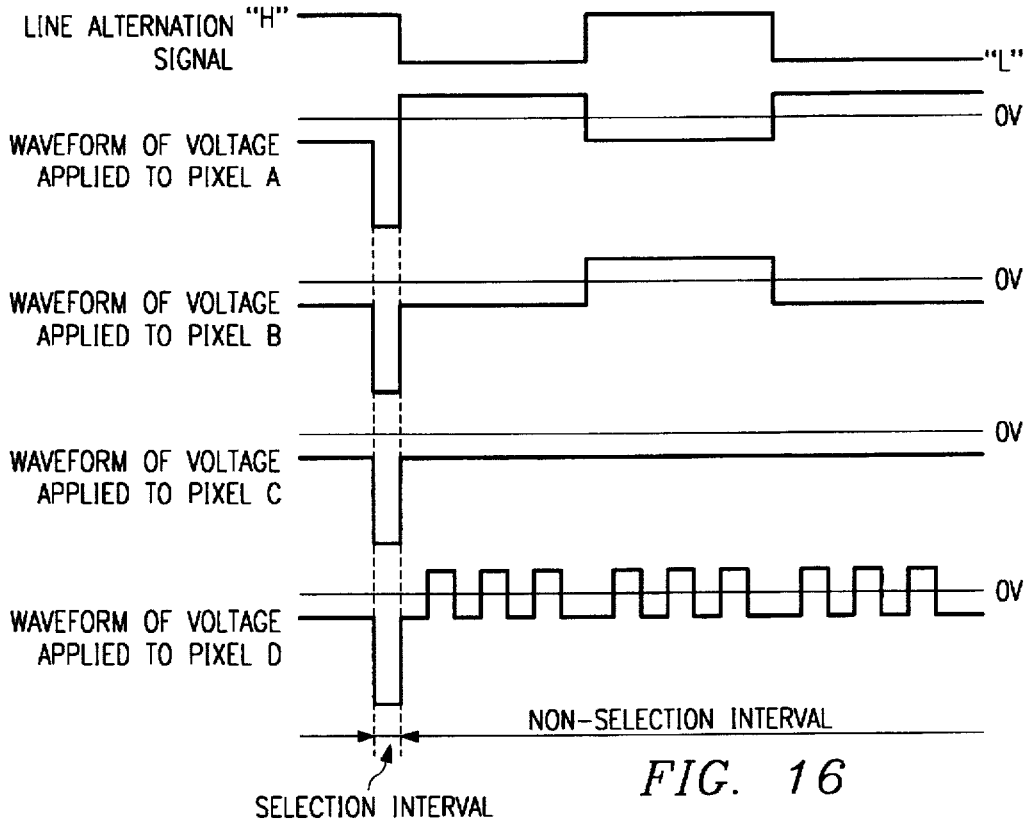
FIG. 16 is a diagram of an embodiment of the waveform of the applied voltage in the conventional line alternation method with respect to pixels A, B, C, and D shown in FIG. 14.

For embodiment, in the case of the display pattern shown in FIG. 14, in the LCD panel driving device in this embodiment, by exchanging $X_{11}$ and $X_{18}$ so that the selection order of the scan lines in the non-selection interval of pixels A, B, C, and D on the seventh scan line becomes $X_8 \rightarrow X_9 \rightarrow X_{10} \rightarrow X_{18} \rightarrow X_{12} \rightarrow X_{13} \rightarrow X_{14} \rightarrow X_{15} \rightarrow X_{16} \rightarrow X_{17} \rightarrow X_{11} \rightarrow X_{19} \ldots$, it is possible to obtain the waveform of the voltage applied to the pixel as shown in FIG. 12, the action takes place in the direction that decreases the waveform variation points and frequency of the waveform of voltage applied to the pixel among pixels A, B, C, and D, the uniformity is improved for the effective voltage or transmissivity, and the display dispersion is improved.

In the embodiment, explanation is made with respect to the seven-line alternation method. However, it is possible to perform alternation for a period made of any number of scan lines. It is also possible to have the interval equal to or longer than a period of alternation between consecutive frames. Selection order decision unit 26 of scan selection control unit 20 is not limited to the random number generator which generates the random number as needed. It is also possible to have a configuration containing a memory which stores a number of random series that can be read as needed.

The method for generating the random numbers is not limited to the mixed congruence method. Other methods may also be adopted. Depending on the selection order using the random number, effective line exchange can be performed for any display pattern. However, it is also possible to determine the selection order for the scan lines according of the prescribed rule and independent to the configuration order.

Also, in the embodiment, the 5-level driving method is adopted. However, other liquid crystal driving methods may also be adopted. For embodiment, this invention may also be implemented by adopting the six-level driving method in which four voltage levels are applied to scan electrode X, and four voltage levels are applied to signal electrode Y. Also, the method and device for driving according to this invention is not limited to STN panels. They may also be adopted for MIM panels, TFD panels, etc.

As explained above, according to this invention, in an interval shorter or longer than an alternation period in the line alternation operation, the selection order of the scan lines is selected randomly, so that the waveform of the voltage applied to the pixel during the non-selection interval on an arbitrary display pattern is set randomly. In this way, it is possible to effectively reduce the effective voltage difference or transmissivity difference between the different pixels during the non-selection interval, and it is possible to suppress the crosstalk without flicker or some other problems.

We claim:

1. A driving circuit for an LCD panel having a number of scan electrodes and a number of signal electrodes arranged to cross each other at intersecting points with liquid crystals sandwiched between them, the pixel located at each intersecting point being turned on/off in accordance with the corresponding absolute value of the difference between the voltage applied to the scan electrode and the voltage applied to the signal electrode, said driving circuit comprising:

a scan electrode driving circuit which for each cycle applies a selection scan voltage to one of the scan electrodes and a non-selection scan voltage to all of the other scan electrodes;

a signal electrode driving circuit which, each time one of the scan electrodes has the selection scan voltage applied to it, applies a selection signal voltage or a non-selection signal voltage to each of the signal electrodes based on the image data corresponding to the various pixels on the scan electrode;

a line alternation forming circuit for inverting the polarity of the voltages respectively applied to the scan electrodes and signal electrodes after every prescribed number of consecutive scan electrodes;

a selection order decision circuit which determines the order of the scan electrodes to which the selection scan voltage is to be applied in an interval shorter or longer than the alternation period corresponding to inversion of the voltage;

a selection order control circuit for controlling the scan electrode driving circuit to ensure that the selection scan voltage is applied to the scan electrodes in the order determined by the selection order decision circuit; and a display control circuit for controlling the signal electrode driving circuit to ensure that the pixels on the scan electrode, to which the selection scan voltage is applied in an order determined by the selection order decision circuit, are turned on/off in accordance with the respective image data.

2. The driving circuit of claim 1, wherein said line alternation forming circuit inverts the polarities of the voltage applied to the scan electrode and the voltage applied to the signal electrode, after every prescribed number of consecutive scan electrodes, in an interval that is shorter or longer than an alternation period for the inversion of the voltage, in a random order that does not pertain to the configuration order.

* * * * *